US006980766B2

(12) United States Patent
Ito

(10) Patent No.: US 6,980,766 B2
(45) Date of Patent: Dec. 27, 2005

(54) IMAGE FORMING DEVICE

(75) Inventor: Sakae Ito, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 63 days.

(21) Appl. No.: 10/809,528

(22) Filed: Mar. 26, 2004

(65) Prior Publication Data

US 2004/0190963 A1 Sep. 30, 2004

(30) Foreign Application Priority Data

Mar. 28, 2003 (JP) ..... 2003-090336

(51) Int. Cl.[7] ..... G03G 15/00; B65H 9/00; B65H 5/22

(52) U.S. Cl. ..... 399/395; 399/82; 399/85; 399/388; 399/394; 399/401; 271/3.08; 271/226; 271/264

(58) Field of Search ..... 399/395, 82, 85, 399/388, 394, 401; 271/3.08, 226, 264

(56) References Cited

U.S. PATENT DOCUMENTS 5,867,761 A * 2/1999 Ishida et al. ..... 399/388
5,878,321 A * 3/1999 Miyazaki et al. ..... 399/388
5,915,158 A * 6/1999 Minagawa et al. ..... 399/370
6,139,206 A * 10/2000 Ahn ..... 400/323

FOREIGN PATENT DOCUMENTS

| | | |
|---|---|---|
| JP | A 6-64817 | 3/1994 |
| JP | A 8-188300 | 7/1996 |
| JP | A 2000-86042 | 3/2000 |
| JP | A 2002-233850 | 8/2000 |
| JP | B2 3147962 | 1/2001 |
| JP | A 2002-49187 | 2/2002 |
| JP | B2 3347656 | 9/2002 |
| JP | A 2002-326768 | 11/2002 |

* cited by examiner

*Primary Examiner*—Andrew H. Hirshfeld
*Assistant Examiner*—Marvin P. Crenshaw
(74) *Attorney, Agent, or Firm*—Oliff & Berridge PLC

(57) ABSTRACT

In a laser printer capable of printing on both sides of a sheet, alignment or skew of the sheet is corrected with register rollers before printing is performed first on a side of the sheet. The sheet with an image having been formed by a process unit is fed to a re-circulation path for printing on the other side of the sheet. The sheet alignment or skew is corrected in the re-circulation path by a guide plate while the sheet is fed by re-circulation feed rollers. The sheet fed back to the register rollers is fed toward the process unit without being temporarily stopped at the register rollers before printing on the other side of the sheet.

20 Claims, 7 Drawing Sheets

IMAGE FORMING DEVICE

BACKGROUND OF THE INVENTION

1. Field of Invention

The invention relates to an image forming device capable of forming images on both sides of a recording medium, and more particularly to an image forming device that corrects an alignment or skew of the recording medium.

2. Description of Related Art

In known image forming devices, such as laser printers and inkjet printers, a sheet is supplied from a sheet supply tray and an alignment or skew of the sheet is corrected by register rollers. More specifically, to correct alignment or skew of the sheet, the register rollers are stopped or reversely rotated while feed rollers are being rotated. As such, the leading edge of the sheet contacts the register rollers thus making the leading edge of the sheet parallel with an axis of the register rollers. Thereafter, the sheet is fed to an image forming unit to form an image on one side of the sheet.

For example, Japanese Laid-Open Patent Publication No. 5-193790 discloses an image forming device capable of forming images on both sides of a sheet. When an image is formed only on one side of the sheet, the sheet having an image formed on one side thereof is fed to discharge rollers and discharged onto a discharge tray. When images are formed on both sides of the sheet, the sheet having an image formed on one side thereof is fed back to the register rollers to form an image on the other or rear side of the sheet.

SUMMARY OF THE INVENTION

Once an image is formed on a flat and smooth sheet, the sheet is often no longer flat and smooth because, for example, heat is applied to the sheet by a fixing unit in laser printers, thus causing the sheet to curl. The sheet also absorbs the moisture from ink in inkjet printers, resulting in changes in the sheet strength or sheet quality. Such a sheet tends to contact the register roller improperly when sheet alignment or skew is corrected with the register rollers, leading to a paper jam.

Accordingly, one exemplary aspect of the invention is to provide an image forming device that forms an image on both sides of a recording medium while occurrences of paper jams are prevented.

According to an exemplary aspect of the invention, an image forming device may include an image forming unit that forms an image on a recording medium having a first face and a second face reverse to the first face, a register roller that is rotatably provided at an upstream portion from the image forming unit and feeds the recording medium toward the image forming unit, a feed unit that is provided at an downstream portion from the image forming unit and feeds the recording medium to the register roller, and a controller that controls rotation of the register roller such that a leading edge of the recording medium is stopped at the register roller when the image has not been formed on the first face, and such that the leading edge of the recording medium is not stopped at the register roller when the recording medium with the image formed on the first face is fed by the feed unit to the register roller.

According to another exemplary aspect of the invention, an image forming device may include an image forming unit that forms an image on a recording medium, the recording medium having a first face and a second face reverse to the first face, a register roller rotatably provided upstream from the image forming unit, the register roller feeding the recording medium toward the image forming unit, a first feed unit provided downstream from the image forming unit, the first feed unit feeding the recording medium to the register roller, a second feed unit provided upstream from the image forming unit, the second feed unit feeding the recording medium to the register roller and a controller that controls a rotation of the register roller such that a leading edge of the recording medium is stopped at the register roller when the recording medium is fed from the second feed unit to the register roller and such that the leading edge of the recording medium is not stopped at the register roller when the recording medium is fed from the first feed unit.

According to another exemplary aspect of the invention, a method of feeding recording medium to an image forming unit that forms an image on the recording medium, the recording medium having a first face and a second face reverse to the first face, may include the steps of determining whether printing as been performed on the first face of the recording medium, stopping a rotation of a register roller, that feeds the recording medium to the image forming unit, for a predetermined period of time after a leading edge of the recording medium contacts the register roller, when an image has not been formed on the first face and maintaining the rotation of the register roller when the image has been formed on the first face.

BRIEF DESCRIPTION OF THE DRAWINGS

An embodiment of the invention will be described in detail with reference to the following figures wherein.

DETAILED DESCRIPTION OF PREFERRED EMBODIMENTS

Figure 1:
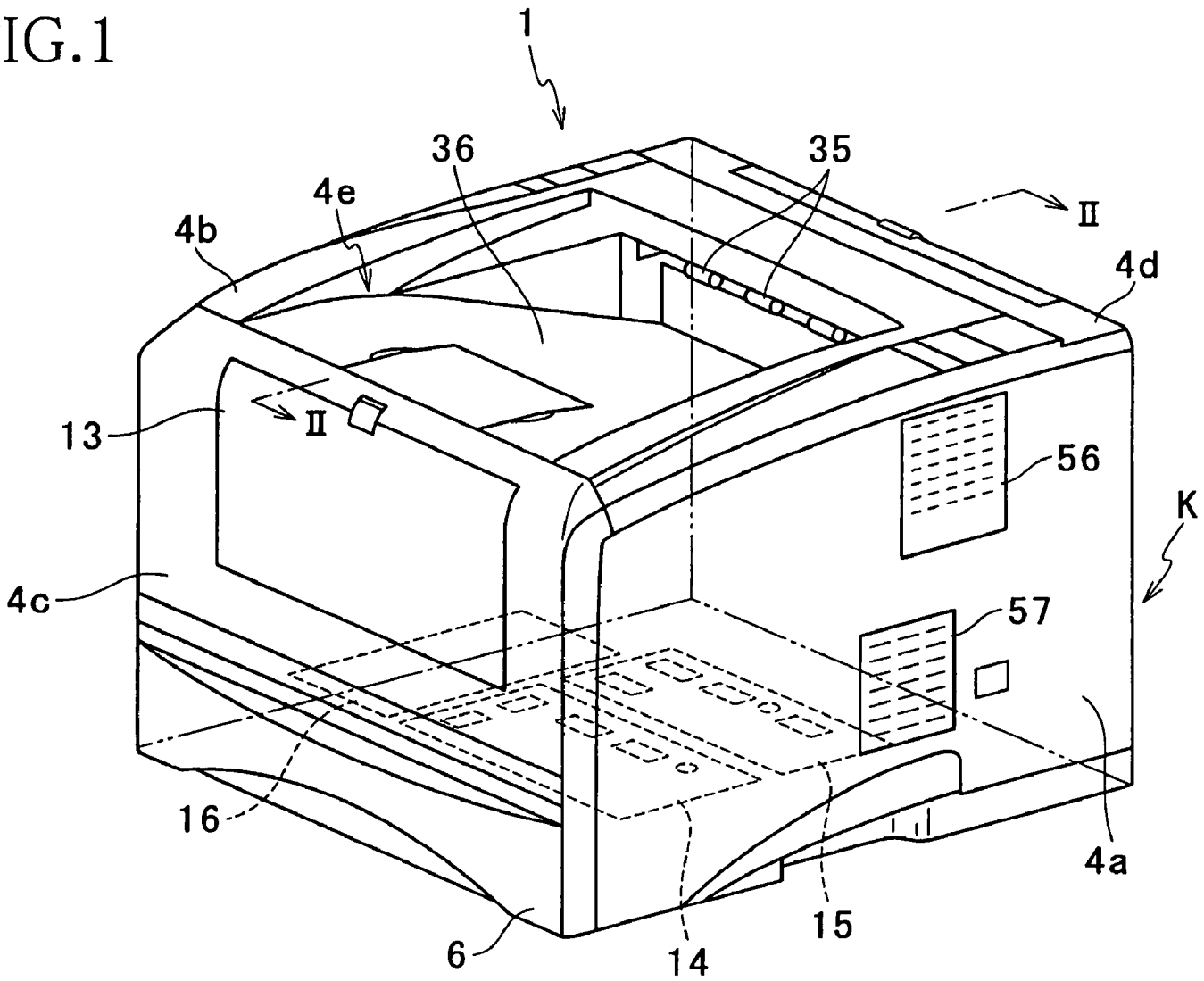
FIG. 1 is a perspective view of a laser printer according to an embodiment of the invention.
Figure 2:
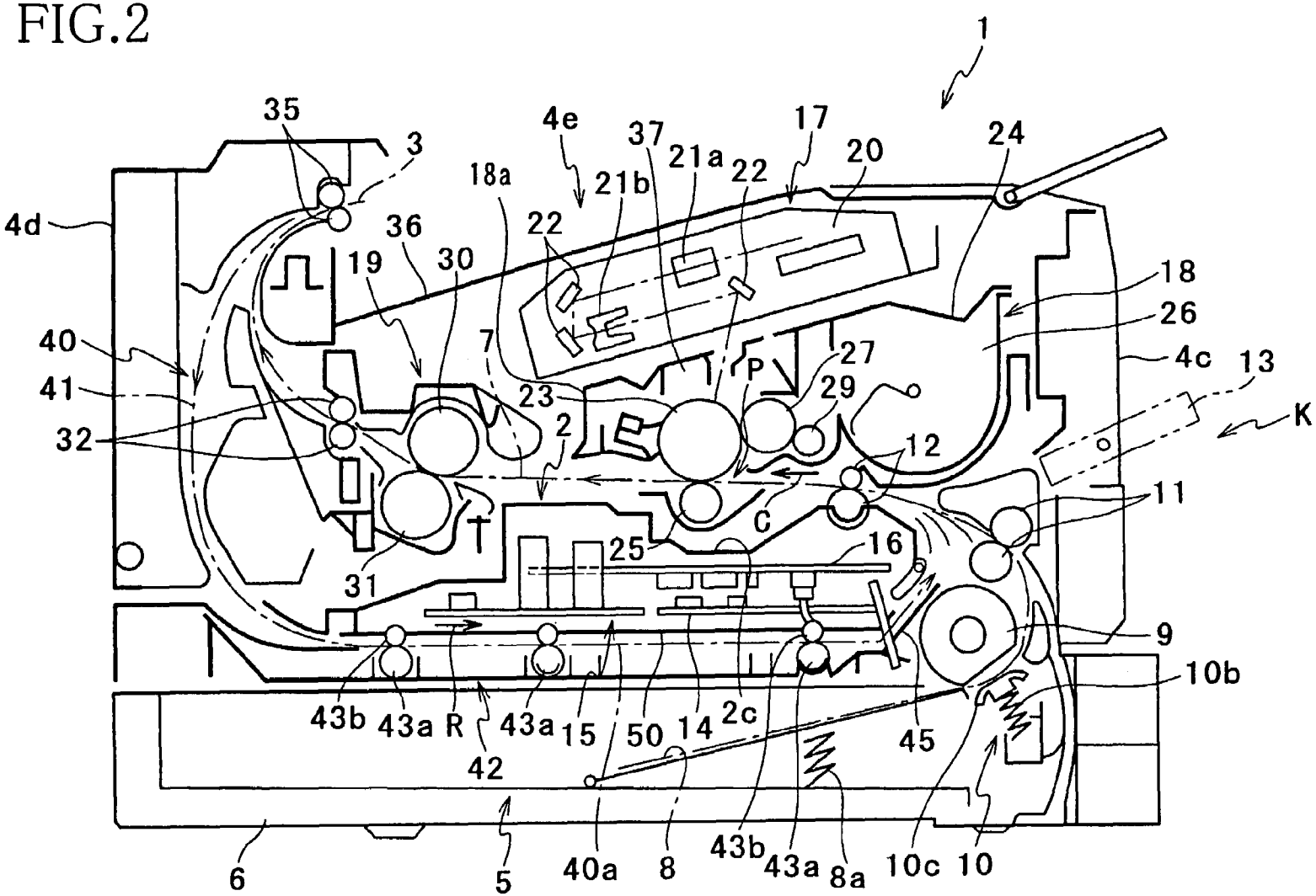
FIG. 2 is a cross sectional view of the laser printer taken along line II—II of FIG. 1.

An embodiment of the invention will be described in detail with reference to the figures. With reference to FIGS. 1 and 2, a laser printer 1 as an image forming device according to an embodiment of the invention will be described. In the embodiment, a front side of the laser printer 1 is defined as a side where a sheet supply tray 6 (described below) is set to or removed from the laser printer 1.

As shown in FIG. 1, the printer 1 has a main case K including side cover members 4*a*, 4*b* provided on the right and left side of the printer 1, front and rear cover members 4*c*, 4*d* provided on the front and rear side of the printer 1, and an upper cover member 4*e* provided with a discharge tray 36 and a control panel (not shown) on the upper side of the printer 1. The cover members 4*a*, 4*b*, 4*c*, 4*d*, 4*e* are made of synthetic resin and removably attached by screws (not shown) to a main frame 2 as will be best seen in FIG. 5.

As shown in FIG. 2, an inner space of the main frame 2 is divided by a partition wall 2*c* into upper and lower portions. Disposed in the upper portion above the partition wall 2*c* are the process unit 18 and a scanner unit 17 that form an image onto a fed sheet, and a fixing unit 19 that fixes the image on the sheet by the application of the heat. Disposed in the lower portion below the partition wall 2*c* are three PCBs (printed circuit boards) 14, 15, 16 and a metal cover plate 50 provided below the PCBs 14, 15, 16.

As shown in FIG. 2, disposed below the cover plate 50 is a feeder section 5 for feeding a cut sheet 3 as a recording medium. The feeder section 5 includes a sheet supply tray 6 removably set in the main frame 2, a sheet mount plate 8 disposed in the sheet supply tray 6, a substantially semicircular pick-up roller 9 that is disposed above an end of the sheet supply tray 6 and intermittently rotates, and a separation pad unit 10 disposed to face the pick-up roller 9.

The sheet mount plate 8 supports a stack of the sheets 3 thereon. The sheet mount plate 8 is urged upwardly at an underside thereof by a spring 8*a* to pivot on one end far from the pick-up roller 9, so that the other end of the sheet mount plate 8 near the pick-up roller 9 can move up and down. With a spring 10*b* of the separation pad unit 10 disposed on an underside of a pad supporting member 10*c*, a separation pad (not shown) formed of a material having a high friction resistance is pressed against the pick-up roller 9.

Widths of the separation pad and the pick-up roller 9 in a direction perpendicular to a sheet feeding direction C are shorter than the width of the sheet 3. When the sheet 3 is picked up and fed by the pick-up roller 9, the sheet, the separation pad and the pick-up roller 9 contact a substantially central portion of the sheet 3 in the sheet width direction.

A sheet transport path 7 is formed between an upper surface of the partition wall 2*c* and the process unit 18. A pair of feed rollers 11 and a pair of register rollers 12 are disposed with some distance between the pairs of rollers 11, 12, at positions downstream of the pick-up roller 9 in the sheet feeding direction C and upstream of an image forming position P of a contact portion between a photosensitive drum 23 and a transfer roller 25 where an toner image on the photosensitive drum 23 is transferred on the sheet 3.

The uppermost sheet 3 on the sheet mount plate 8 is pressed against the pick-up roller 9. By the rotation of the pick-up roller 9, the sheet 3 is held between the pick-up roller 9 and the separation pad unit 10 and fed to the feed rollers 11 and the register rollers 12. Thus, the sheets P on the sheet mount plate 8 are separated and fed one by one in the sheet feeding direction C. The alignment or skew of the sheet 3 is corrected with the register rollers 12, as will be described in detail below, and then fed to the image forming position P for image formation with the process unit 18.

As shown in FIGS. 1 and 2, a manual feed tray 13 for supplying the sheets 3 manually set thereon is pivotally provided downstream of the feed rollers 11 so as to open and close on one side of the main case K.

A scanner unit 17 is disposed inside the upper cover member 4*e* of the main case K below the discharge tray 36. The scanner unit 17 includes a laser emitting section (not shown), a polygon mirror 20 that is driven so as to spin, lenses 21*a*, 21*b*, and reflecting mirrors 22. Laser beam emitted from the laser emitting section based on image data passes through or reflects off the polygon mirror 20, the lens 21*a*, the reflecting mirrors 22, and the lens 21*b*, in this order. The laser beam scans at a high speed across a surface of the photosensitive drum 23.

The process unit 18 includes a photosensitive member cartridge 18*a* and a developing cartridge 24 detachably mounted on the photosensitive member cartridge 18*a*. The photosensitive member cartridge 18*a* includes the photosensitive drum 23, a scorotron charger 37, and a transfer roller 25. The developing cartridge 24 includes a toner box 26, a developing roller 27, a toner layer thickness regulating blade (not shown), and a toner supply roller 29.

The toner box 26 accommodates positively chargeable non-magnetic single component polymerized toner, as a developing agent. The toner is supplied to the developing roller 27 by the toner supply roller 29. The toner is positively charged by the friction between the toner supply roller 29 and the developing roller 27. As the developing roller 27 rotates, the toner is carried on the developing roller 27 as a constant thin thickness toner layer because of a frictional sliding relation with the toner layer thickness regulating blade. The photosensitive drum 23 is rotatably disposed in confronting relation to the developing roller 27. The photosensitive drum 23 includes a drum body which is grounded, and a positively chargeable photosensitive layer made from organic photosensitive material of, for example, polycarbonate formed over the drum body.

The scorotron charger 37 is disposed above the photosensitive drum 23 with a predetermined distance therebetween, to prevent the charger 37 from contacting the photosensitive drum 23. The charger 37 is a positively charging scorotron charger that generates corona discharge from a tungsten wire. The charger 37 uniformly and positively charges the surface of the photosensitive drum 23.

The laser beam emitted from the scanner unit 17 scans at a high speed across the surface of the photosensitive drum 23, which is uniformly and positively charged by the charger 37 while the photosensitive drum 23 is rotated. The surface of the photosensitive drum 23 is selectively exposed to the laser beam, forming an electrostatic latent image thereon, based on image data. By the rotation of the developing roller 27 having the positively charged toner thereon, the toner is brought into contact with the photosensitive drum 23. The toner is supplied to the electrostatic latent image formed on the surface of the photosensitive drum 23, making the toner image visible. In other words, the toner is supplied to parts of the photosensitive drum 23 selectively exposed to the laser beam where the potential level is lower than the remaining part of the photosensitive drum 23 surface uniformly positively charged. Thus, the visible toner image is formed on the photosensitive drum 23.

The transfer roller 25 is positioned immediately below the photosensitive drum 23. The transfer roller 25 includes a metal roller shaft covered by a roller portion formed of ionic conductive rubber. A transfer bias is applied to the transfer roller 25 by a transfer bias application power source (not shown). By the application of the transfer bias, the visible toner image on the photosensitive drum 23 is transferred onto the sheet 3 while the sheet 3 passes between the photosensitive drum 23 and the transfer roller 25.

The fixing unit 19 is positioned downstream of the process unit 18 in the sheet feeding direction C. The fixing unit 19 includes a heat roller 30, a pressure roller 31 in pressure contact with the heat roller 30, and a pair of feed rollers 32 positioned downstream of the heat roller 30 and the pressure roller 31. The heat roller 30 is made from a metal, such as aluminum, and is provided with a halogen lamp as a heat source. The toner image transferred onto the sheet 3 at the process unit 18 is thermally fixed to the sheet 3 while the sheet 3 passes between the heat roller 30 and the pressure roller 31. The sheet 3 is then delivered to the feed rollers 32 and discharge rollers 35 disposed inward from the rear cover member 4*d* of the main case K. The sheet 3 having the image formed thereon is discharged onto the discharge tray 36 by way of the discharge rollers 35.

The laser printer 1 is capable of forming an image on a single or both side(s) of the sheet 3. Printing operations performed to form images on both sides of the sheet 3 will be described below.

The laser printer 1 includes a sheet re-circulation unit 40 for turning the sheet 3 having an image formed on one side thereof at the process unit 18 upside down and for feeding the sheet 3 to the register rollers 12, to form images on both surfaces of the sheet 3. As shown in FIG. 2, the re-circulation unit 40 includes the discharge rollers 35, a re-circulation tray 42 detachably mounted above the sheet supply tray 6, a plurality of pairs of re-circulation feed rollers 43*a*, 43*b* disposed along a re-circulation direction R with some distance between each pair of re-circulation feed rollers 43*a*, 43*b*, and a guide plate 46 (shown in FIGS. 3 and 4).

The discharge rollers 35 are selectively rotated in the forward or reverse direction to turn the sheet 3 upside down through a reverse path 41. The reverse path 41 is connected to the substantially horizontal re-circulation path 40*a* defined between the cover plate 50 and the sheet supply tray 6.

Figure 3:
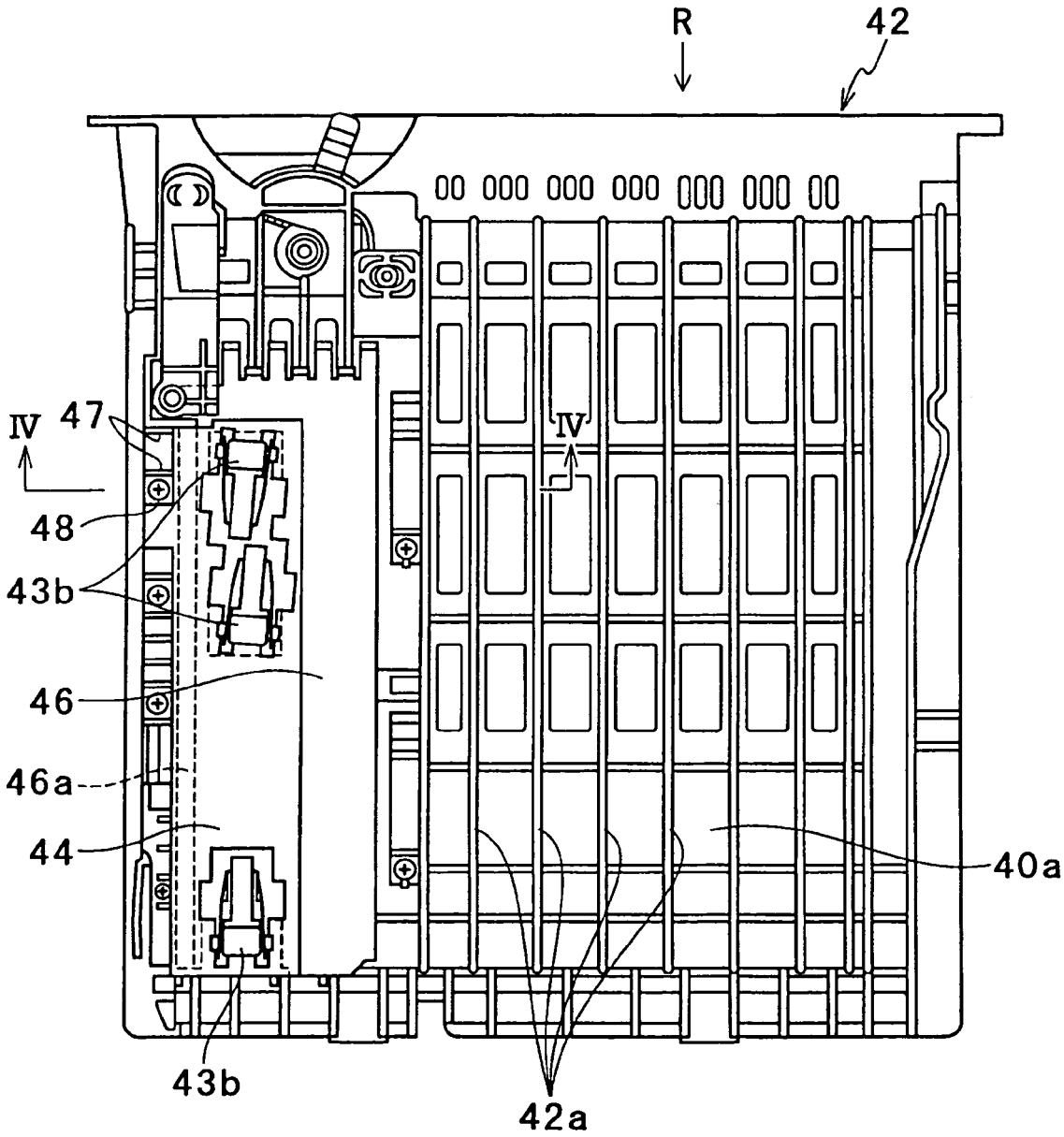
FIG. 3 is a plane view of a re-circulation tray of the laser printer.
Figure 4:
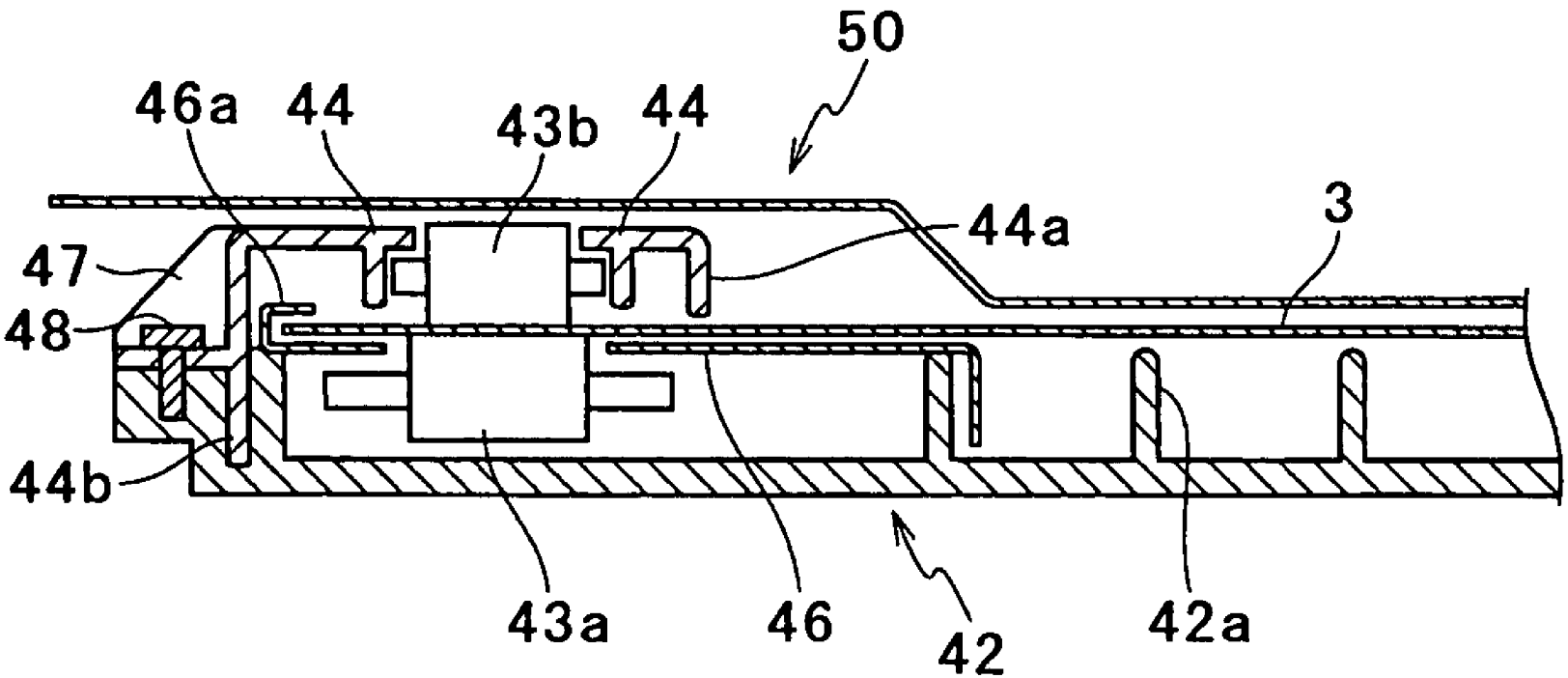
FIG. 4 is a cross sectional view of the re-circulation tray taken along line IV—IV of FIG. 3.

With reference to FIGS. 3 and 4, the re-circulation tray 42, the re-circulation feed rollers 43*a*, 43*b*, and the guide plate 46 are described in detail below. As shown in FIG. 3, the guide plate 46 is disposed on an upper side of the re-circulation tray 42 to extend in the re-circulation direction R on one side of the tray 42 in the sheet width direction. The guide plate 46 has a guide edge 46*a* formed on one side thereof into a substantially "U" or "J" shape in cross section, as show in FIG. 4. One side edge of the sheet 3 is guided by the guide edge 46*a* in the re-circulation direction R.

The re-circulation tray 42 has a plurality of guides 42*a* formed on the right side in FIGS. 3 and 4 where the guide plate 46 is not disposed, to extend upwardly from a bottom surface of the re-circulation tray 42, as shown in FIG. 4. The guides 42*a* support an underside of the sheet 3 where an image has not yet formed.

As shown in FIG. 4, pairs of the re-circulation feed rollers 43*a*, 43*b* are disposed below and above the guide plate 46, respectively, on one side of the re-circulation tray 42 in the sheet width direction where the guide plate 46 is disposed. The lower re-circulation feed rollers 43*a* are driven by drive gears, belts and pulleys (not shown). The upper re-circulation feed rollers 43*b* are pressed against the lower re-circulation feed rollers 43*a* by urging devices, such as torsion springs. In accordance with the rotation of the lower re-circulation feed rollers 43*a*, the upper re-circulation feed rollers 43*b* are rotated in a direction opposite in rotation from the lower re-circulation feed rollers 43*a*.

As shown in FIG. 3, an axial direction of the upstream-side upper re-circulation feed rollers 43*b* in the re-circulation direction R intersects a line perpendicular to the re-circulation direction R. The re-circulation direction R and the direction perpendicular to the axial direction of the upstream-side upper re-circulation feed rollers 43*b* define angles of approximately 0 to 45 degrees. With the arrangement of the upper re-circulation feed rollers 43*b*, such a feeding force that brings the sheet 3 toward the guide edge 46*a* is applied to the sheet 3. Axial directions of the lower re-circulation feed rollers 43*a* and that of the downstream-side upper re-circulation feed roller 43*b* are perpendicular to the re-circulation direction R.

The sheet 3 in the re-circulation path 40*a* is held between the re-circulation feed rollers 43*a*, 43*b* and fed in the re-circulation direction R, as the rollers 43*a*, 43*b* are rotated, with one side edge of the sheet 3 being guided by the guide edge 46*a* of the guide plate 46. Thus, the position of a side edge of the sheet 3 is restricted by the guide edges 46*a* and sheet alignment or skew is corrected in the re-circulation path 40*a*.

As shown in FIG. 4, each upper re-circulation feed roller 43*b* is supported at each end of its shaft by a roller holder 44 made of, for example, resin material. Each lower re-circulation feed roller 43*a* is supported by the re-circulation tray 42 at each end of its shaft (detail illustration showing the roller 43*a* supporting manner is omitted). The guide plate 46 is disposed between the roller holder 44 and the re-circulation tray 42 with the guide edge 46*a* protected by the roller holder 44.

The roller holder 44 has a projection 44*b* that fits or engages in a recess formed in the re-circulation tray 42. Disposed at a side of the projection 44*b* are a plurality of reinforcing ribs 47 arranged in the re-circulation direction R with some distance therebetween, as shown in FIG. 3. The roller holder 44 fitted in the re-circulation tray 42 is secured by a plurality of screws 48 along the re-circulation direction R on a side of the roller holder 44 where the reinforcing ribs 47 are formed. The roller holder 44 is supported by the re-circulation tray 42 in a cantilever manner.

A rib 44*a* extending downward toward the sheet 3 is provided for the roller holder 44 on a side opposite from the protrusion 44*b* (right side in FIG. 4). The rib 44*a* prevents a finger of a user from getting caught in the roller holder 44, so that the roller holder 44 is prevented from being broken by the force applied by the user in the upward direction when the finger gets caught in the holder 44.

The PCBs 14, 15, as shown in FIG. 2, are disposed above the re-circulation path 40*a* on a side (right side in FIG. 3) where the re-circulation feed rollers 43*a*, 43*b* are not disposed.

The sheet 3 passes over the re-circulation tray 42 and is fed again to the register rollers 12, through a re-circulation guide 45, as shown in FIG. 2. The sheet 3 having an image formed on one side thereof, is fed to the process unit 18 without being stopped at the register rollers 12, that is, without stopping the rotation of the register rollers 12.

When a printing operation is performed for both sides of the sheet 3, alignment or skew of the sheet 3 having no image formed on either side thereof is corrected by the register rollers 12. The alignment or skew of the sheet 3 having an image formed on one side thereof is not corrected by the register rollers 12.

The correction of the alignment or skew of the sheet 3 with the register rollers 12 will be described in detail below. The sheet 3 is fed toward the register rollers 12, whose rotation has been temporarily stopped as the leading edge of the sheet 3 contacts the register rollers 12. In this state, as the feed rollers 11 are continuously rotated, the leading edge of the sheet 3 and the rotation axis of the register rollers 12 are made parallel. Thus, the alignment or skew of the sheet 3 are corrected with the register rollers 12. The register rollers 12 are rotated again after the passage of a predetermined period of time, to feed the sheet toward the process unit 18.

Figure 5:
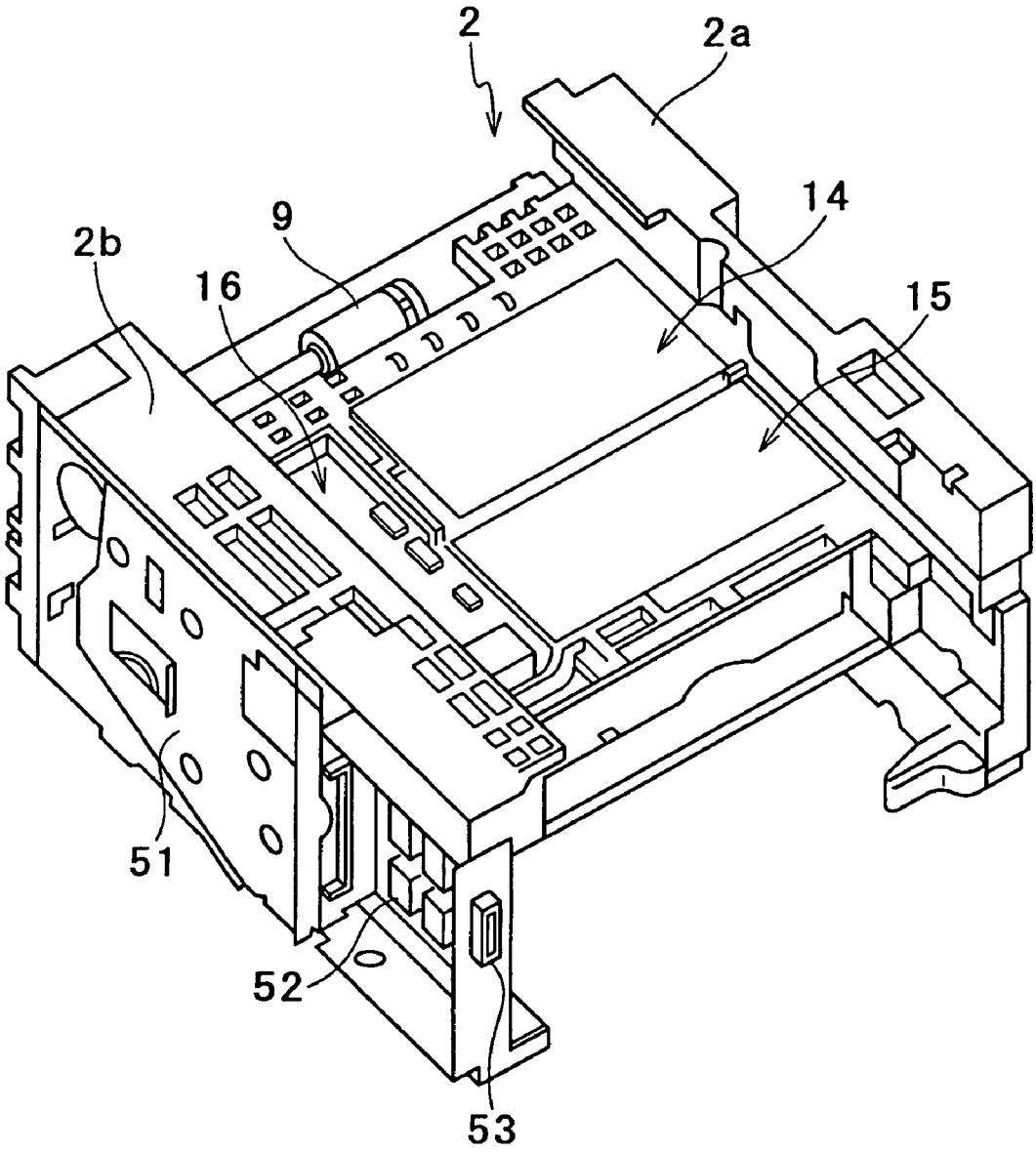
FIG. 5 is a perspective view of a main frame of the laser printer viewed from a rear side of the frame.
Figure 6:
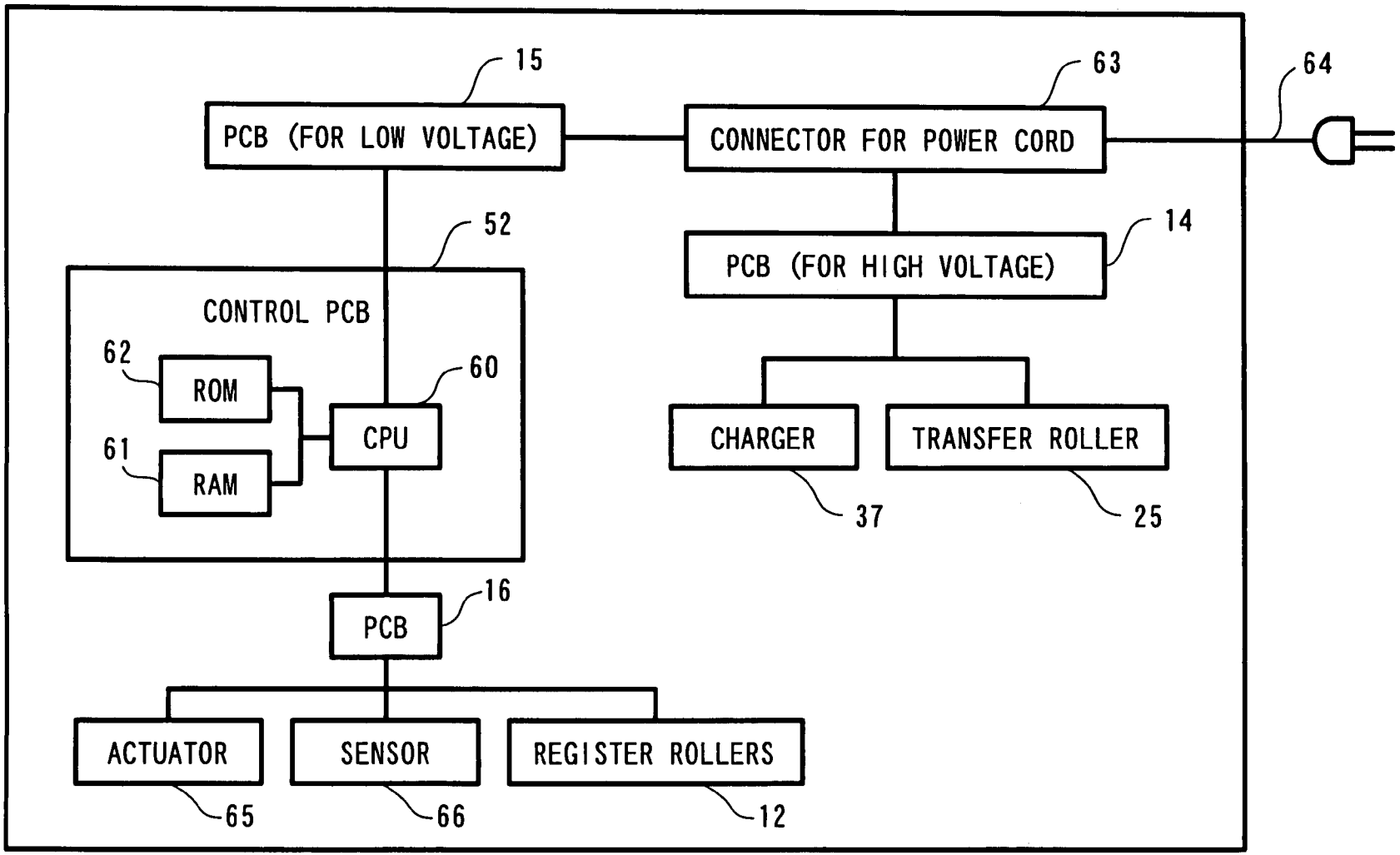
FIG. 6 is a block diagram showing an electric configuration of the laser printer.
Figure 7:
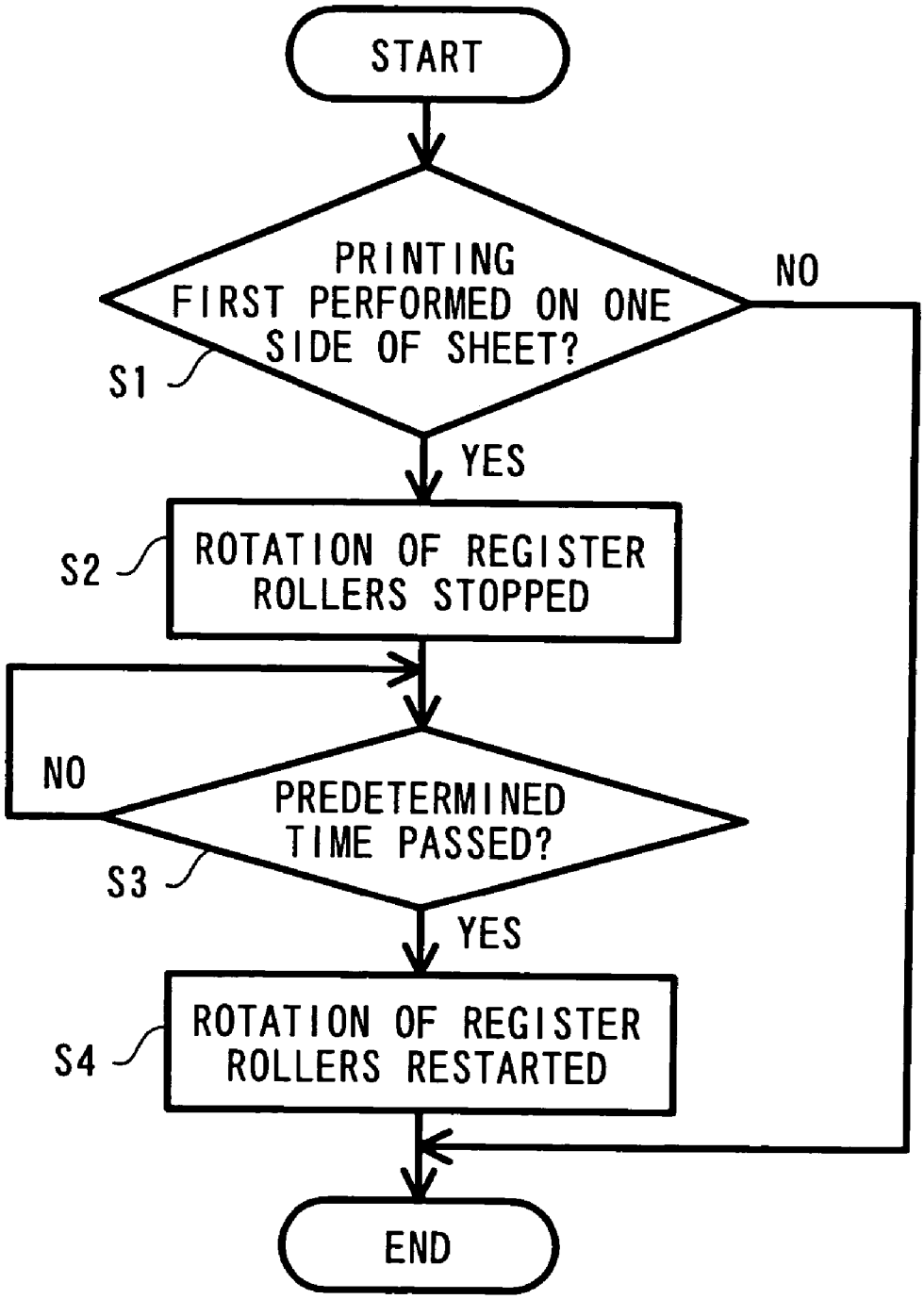
FIG. 7 is a flowchart showing processes for controlling the rotation of a pair of register rollers with a control PCB (printed circuit board) of the laser printer.

The rotation of the register rollers 12 is stopped or re-started under the control of a control PCB 52, as shown in FIGS. 5 and 6. With reference to a flowchart of FIG. 7, an operation of the register rollers 12 controlled by the control PCB 52 is described. At the start of the flowchart, the register rollers 12 are rotating. Before the sheet 3 reaches the register rollers 12, it is determined whether the printing is first performed on a side of the sheet 3 (S1). If the printing is first performed on a side of the sheet 3 (S1: YES), the rotation of the register rollers 12 is stopped (S2). The time that the register rollers 12 are stopped is predetermined. As the predetermined time has passed (S3: YES), the register rollers 12 start rotating again (S4). While the register rollers 12 stop rotating, the alignment or skew of the sheet 3 is corrected. When the printing is performed on the other or rear side of the sheet 3 (S1: NO), the rotation of the register rollers 12 are not stopped.

With reference to FIGS. 5 and 6, devices that control operations of the laser printer 1 will be described. As shown in FIG. 5, the main frame 2 includes a right and left frame 2*a*, 2*b*, respectively. Disposed outside the left frame 2*b* is a metal drive transmission frame 51 that is provided with drive gears for driving the pick-up roller 9, the photosensitive drum 23, the transfer roller 25, the developing roller 27, the heat roller 30, and the lower re-circulation feed rollers 43*a*. The control PCB 52 including a central processing unit (CPU) 60, a random access memory (RAM) 61, and a read only member (ROM) 62 is mounted on the left frame 2*b* adjacent to the drive transmission frame 51 on the rear side of the laser printer 1. The laser printer 1 is provided on a rear side thereof with a connector 53 for connection to an external device and a connector 63 for a power cord (in FIG. 6).

Disposed outside the right frame 2*a* are cooling fans (not shown) that release heat generated by the fixing unit 19 and the PCBs 14, 15, 16 outside the main case K. In association with the cooling fans, air ducts 56, 57 (in FIG. 1) are disposed on the right side cover member 4*a*. The heat is released outside the laser printer 1 through the air ducts 56, 57.

As shown in FIG. 6, the PCB 14 is for high voltage application to, for example, the charger 37 of the process unit 18 and the transfer roller 25. The PCB 15 is for low voltage application to, for example, the control PCB 52, by lowering the commercial power supplied through a power cord 64 to a predetermined low voltage. The PCB 16 is connected to the control PCB 52. The PCB 16 drives, based on the instruction of the CPU 60 mounted on the control PCB 52, an actuator 65 of an electromagnetic solenoid at the feeder section 5 and the register rollers 12, as well as supplies signals from various sensors 66 to the control PCB 52.

As described above, when the laser printer 1 according to the embodiment performs printing on both sides of the sheet 3, the leading end of the sheet 3 is temporarily stopped by the register rollers 12 to correct the alignment or skew of the sheet 3 before first printing on one side of the sheet 3. When printing is performed on the other side of the sheet 3, the sheet 3 is fed to the process unit 18 without correcting the alignment or skew of the sheet 3 with the register rollers 12. There will be a higher necessity of correcting the alignment or skew of the sheet 3 before printing first on a side of the sheet 3, because the sheet 3 may possibly be fed on the skew, according to the user's manner of setting the sheet 3 in the laser printer 1. On the contrary, there will be a lower necessity of correcting the sheet alignment or skew when printing on the other side of the sheet 3, because significant skew will not occur after the sheet 3 is registered with the register rollers 12 for correction of the sheet alignment or skew before first printing on a side of the sheet 3. For those reasons, the laser printer 1 according to the embodiment is structured such that the sheet 3 is registered with the register rollers 12 before printing first on a side of the sheet 3 and is not registered with the register rollers 12 before printing on the other side of the sheet 3.

After printing on a side of the sheet 3, the sheet 3 might be curled or its quality might be changed, so that a paper jam tends to occur if the leading edge of the sheet 3 having an image formed on a side thereof, is temporarily stopped at the register rollers 12. In the embodiment, the sheet 3 with an image having been formed on one side thereof is not registered by the register rollers 12. Thus, the paper jam is prevented. The sheet transport path 7 is not structured to eliminate the curl in the sheet 3 caused due to the heat application by the fixing unit 19. However, the paper jam can be prevented, as described above, without a sheet transport path that eliminates the curl in the sheet.

In the embodiment, the sheet 3 with an image having been formed on one side thereof is not registered by the register rollers 12 before printing on the other side of the sheet 3. Therefore, sounds or noises are prevented that are caused when the leading edge of the sheet 3 contacts the register rollers 12 or caused by a clutch that controls the rotation of the register rollers 12. Thus, printing is performed quietly.

The sheet 3 with an image having been formed on one side thereof is fed in the re-circulation direction R by the re-circulation feed rollers 43*a*, 43*b*, with a side edge of the sheet 3 guided by the guide edge 46*a* of the guide plate 46. The re-circulation feed rollers 43*a*, 43*b* apply to the sheet 3 a feeding force that brings the sheet 3 toward the guide edge 46*a*, so that the sheet 3 is fed along the guide edge 46*a* while the alignment or skew of the sheet 3 is corrected. Not by the register rollers 12 but by the re-circulation feed rollers 43*a*, 43*b* and the guide plate 46, the sheet alignment or skew is corrected before printing is performed on the other or rear side of the sheet 3. Accordingly, printing is favorably performed on the sheet 3 without skew of an image on each side of the sheet 3.

In the embodiment, the guide plate 46 is disposed on one side of the re-circulation tray 42 in the sheet width direction to extend in the re-circulation direction R. The re-circulation feed rollers 43*a*, 43*b* are disposed on the same side as the guide plate 46. If the guide plates 46 are disposed on both sides of the re-circulation tray 42 in the sheet width direction, or the re-circulation feed rollers 43*a*, 43*b* are disposed to contact the entire surface of the sheet 3, size and cost reductions for the laser printer 1 are difficult. However, in the embodiment, the guide plate 46 and the re-circulation feed rollers 43*a*, 43*b* are disposed only on one side of the re-circulation tray 42 in the sheet width direction. Therefore, size and costs of the printer 1 can be reduced.

The PCBs 14, 15 are disposed above the re-circulation path 40*a* on a side where the re-circulation feed rollers 43*a*, 43*b* are not disposed. Thus, space in the printer 1 is effectively used to reduce the size of the printer 1.

The re-circulation feed rollers 43*b* are supported by the roller holder 44 that is securely supported in the re-circulation tray 42, as shown in FIG. 4. In addition, assembly or engagement of the roller holder 44 in the re-circulation tray 42 can be readily performed.

In the laser printer 1, the sheets 3 tend to curl due to the application of the heat by the fixing unit 19. Therefore, paper jam can be an issue for double or both side printing, because the curled sheet 3 may jam at the register rollers 12 before an image is formed on the other or rear side of the sheet 3. However, in the embodiment, the sheet 3 is only registered by the register rollers 12 when printing is first performed on one side of the sheet 3 and is not registered by the register rollers 12 before printing on the other side of the sheet 3. Accordingly, a paper jam can be prevented.

While the invention has been described with reference to the embodiment, it is to be understood that the invention is not restricted to the particular forms shown in the foregoing embodiment. Various modifications and alterations can be made thereto without departing from the scope of the invention, as set forth in the appended claims.

For example, the alignment or skew of the sheet 3 may be corrected before printing is first performed on a side of the sheet, not only by stopping the register rollers 12 for a predetermined period of time, but by rotating the register rollers 12 in the reverse direction. In other words, the rotation of the register rollers 12 may be controlled such that the leading end of the sheet 3 is temporarily stopped at the register rollers 12 before printing is performed first on a side of the sheet 3.

As long as the sheet re-circulation unit 40 feeds the sheet 3 to the register rollers 12 again after printing is performed on one side of the sheet 3, by turning the sheet 3 to face the other side thereof upwardly, the sheet re-circulation unit 40 may be made up of other components than the discharge rollers 35, the re-circulation tray 42, the re-circulation feed rollers 43*a*, 43*b*, and the guide plate 46.

The roller holder 44 may be fixed on to the re-circulation tray 42, for example, by fasteners, such as bolts and screws, without fitting the projection 44*b* of the roller holder 44 in the re-circulation tray 42. Further, the roller holder 44 may be supported in different manners from the cantilever manner.

To apply the feeding force that brings the sheet 3 toward the guide plate 46 and feed the sheet 3 along the guide edge 46, various manners may be employed other than the manner that the axial direction of the upper re-circulation feed roller 43*b* is in disagreement with the sheet width direction.

The plurality of pairs of the re-circulation feed rollers 43*a*, 43*b* are disposed along the re-circulation direction R on one side of the re-circulation tray 42 in the sheet width direction. However, the re-circulation feed rollers 43*a*, 43*b* may be disposed in a direction perpendicular to the re-circulation direction R across the width of the sheet 3. The axial direction of the upper re-circulation feed roller 43*b* may be the same direction as the sheet width direction, similar to the lower re-circulation feed roller 43*a*.

To effectively use the space of the laser printer 1, the PCBs 14, 15 are disposed above the re-circulation path 40 on a side where the re-circulation feed rollers 43*a*, 43*b* are not disposed. However, the PCBs may be disposed on different positions.

Correction of the sheet alignment or skew after the printing on one side of the sheet may be omitted. In the embodiment, the sheet alignment or skew is corrected by the guide plate 46 and the re-circulation feed rollers 43*a*, 43*b* after the printing on one side of the sheet 3. However, the sheet 3 may be fed again to the register rollers 12 for printing on the other side of the sheet 3, without correcting the sheet alignment or skew with the guide plate 46 and the re-circulation feed rollers 43*a*, 43*b*.

The embodiment is described in conjunction with the laser printer 1 as an example of the image forming device of the invention. However, the image forming device is not limited to the laser printer but the invention may be applied to an inkjet printer.

What is claimed is:

1. An image forming device, comprising:

an image forming unit that forms an image on a recording medium, the recording medium having a first face and a second face reverse to the first face;

a register roller rotatably provided upstream from the image forming unit, the register roller feeding the recording medium toward the image forming unit;

a feed unit provided downstream from the image forming unit, the feed unit feeding the recording medium to the register roller; and a controller that controls a rotation of the register roller such that a leading edge of the recording medium is stopped at the register roller when an image has not been formed on the first face and such that the leading edge of the recording medium is not stopped at the register roller when the recording medium with the image formed on the first face is fed by the feed unit to the register roller.

2. The image forming device according to claim 1, wherein the feed unit further comprises:

a guide portion, extending in parallel with a feed direction of the recording medium, that guides a side edge of the recording medium in the feed direction; and a pair of feed rollers that feed the recording medium in the feed direction, wherein the pair of feed rollers are disposed such that recording medium moves toward the guide portion.

3. The image forming device according to claim 2, wherein the feed direction and a direction in which the recording medium is moved by the pair of feed rollers define a predetermined angle that is between 0 degree to 45 degrees.

4. The image forming device according to claim 2, wherein the guide portion and the pair of feed rollers are provided at one side of the feed unit in the feed direction.

5. The image forming device according to claim 4, wherein a circuit board is provided at another side of the feed unit in the feed direction.

6. The image forming device according to claim 2, wherein the feed unit further comprises:

a feed tray that supports the recording medium thereon fed in the feed direction; and a roller holder, provided at one side of the feed tray in the feed direction, that holds one of the pair of feed rollers.

7. The image forming device according to claim 1, wherein the image forming unit further comprises:

a fixing unit that fixes the image on the recording medium, wherein the image forming unit forms the image on the recording medium in an electrophotographic process, the feed unit being provided at the downstream portion from the fixing unit.

8. The image forming device according to claim 2, wherein the guide portion further comprises:

a guide plate extending in parallel with the feed direction of the recording medium; and a guide edge formed on one side of the guide portion that guides the side edge of the recording medium in the feed direction.

9. The image forming device according to claim 1, wherein the feed unit further comprises:

a guide portion, extending in parallel with a feed direction of the recording medium, that guides a side edge of the recording medium in the feed direction;

an upstream pair of feed rollers that are disposed such that the recording medium moves toward the guide portion; and a downstream pair of feed rollers that are disposed such that the recording medium moves in a direction parallel to the feed direction.

10. The image forming device according to claim 1, comprising:

a second feed unit provided upstream from the image forming unit, the second feed unit feeding the recording medium to the register roller.

11. An image forming device, comprising:

an image forming unit that forms an image on a recording medium, the recording medium having a first face and a second face reverse to the first face;

a register roller rotatably provided upstream from the image forming unit, the register roller feeding the recording medium toward the image forming unit;

a first feed unit provided downstream from the image forming unit, the first feed unit feeding the recording medium to the register roller;

a second feed unit provided upstream from the image forming unit, the second feed unit feeding the recording medium to the register roller; and a controller that controls a rotation of the register roller such that a leading edge of the recording medium is stopped at the register roller when the recording medium is fed from the second feed unit to the register roller and such that the leading edge of the recording medium is not stopped at the register roller when the recording medium is fed from the first feed unit.

12. The image forming device according to claim 11, wherein the first feed unit further comprises:

a guide portion, extending in parallel with a feed direction of the recording medium, that guides a side edge of the recording medium in the feed direction; and a pair of feed rollers that feed the recording medium in the feed direction, wherein the pair of feed rollers are disposed such that recording medium moves toward the guide portion.

13. The image forming device according to claim 12, wherein the feed direction and a direction in which the recording medium is moved by the pair of feed rollers define a predetermined angle that is between 0 degree to 45 degrees.

14. The image forming device according to claim 12, wherein the guide portion and the pair of feed rollers are provided at one side of the first feed unit in the feed direction.

15. The image forming device according to claim 14, wherein a circuit board is provided at another side of the first feed unit in the feed direction.

16. The image forming device according to claim 12, wherein the first feed unit further comprises:

a feed tray that supports the recording medium thereon fed in the feed direction; and a roller holder, provided at one side of the feed tray in the feed direction, that holds one of the pair of feed rollers.

17. The image forming device according to claim 11, wherein the image forming unit further comprises:

a fixing unit that fixes the image on the recording medium, wherein the image forming unit forms the image on the recording medium in an electrophotographic process, the first feed unit being provided at the downstream portion from the fixing unit.

18. The image forming device according to claim 12, wherein the guide portion further comprises:

a guide plate extending in parallel with the feed direction of the recording medium; and a guide edge formed on one side of the guide portion that guides the side edge of the recording medium in the feed direction.

19. The image forming device according to claim 11, wherein the first feed unit further comprises:

a guide portion, extending in parallel with a feed direction of the recording medium, that guides a side edge of the recording medium in the feed direction;

an upstream pair of feed rollers that are disposed such that the recording medium moves toward the guide portion; and a downstream pair of feed rollers that are disposed such that the recording medium moves in a direction parallel to the feed direction.

20. A method of feeding recording medium to an image forming unit that forms an image on the recording medium, the recording medium having a first face and a second face reverse to the first face, comprising:

determining whether printing has been performed on the first face of the recording medium;

stopping a rotation of a register roller, that feeds the recording medium to the image forming unit, for a predetermined period of time after a leading edge of the recording medium contacts the register roller, when an image has not been formed on the first face; and maintaining the rotation of the register roller when the image has been formed on the first face.

* * * * *